United States Patent [19]

Reszka

[11] 4,344,243

[45] Aug. 17, 1982

[54] ANIMATED CHRISTMAS DISPLAY DEVICE

[76] Inventor: Leon Reszka, 49 Huber Pl., Yonkers, N.Y. 10704

[21] Appl. No.: 166,480

[22] Filed: Jul. 7, 1980

[51] Int. Cl.[3] ..... G09F 19/08; A63H 11/00; A63H 13/02

[52] U.S. Cl. ..... 40/415; 40/414; 46/122; 46/120; 46/140; 46/13

[58] Field of Search ..... 40/411, 414, 415, 430; 46/122, 137, 138, 140, 119, 120, 130, 134, 118, 121, 13; 368/15-18, 272

[56] References Cited

U.S. PATENT DOCUMENTS

| | | | |
|---|---|---|---|
| 2,093,710 | 9/1937 | Conley | 40/411 X |
| 2,504,811 | 4/1950 | Davis et al. | 368/272 |
| 2,585,467 | 2/1952 | Huth | 46/138 X |
| 2,628,722 | 2/1953 | Walsh | 40/415 X |
| 2,874,513 | 2/1959 | Connell | 40/415 X |
| 2,942,378 | 6/1960 | Ellis | 46/122 X |
| 3,442,512 | 5/1969 | Glass et al. | 46/120 X |
| 3,605,305 | 9/1971 | Grigorian | 40/415 |
| 3,888,023 | 6/1975 | Genin | 40/411 X |

FOREIGN PATENT DOCUMENTS

| | | | |
|---|---|---|---|
| 1213342 | 3/1960 | France | 40/415 |

*Primary Examiner*—Gene Mancene
*Assistant Examiner*—Michael J. Foycik
*Attorney, Agent, or Firm*—Curtis, Morris & Safford

[57] ABSTRACT

An animated display showing the Nativity scene. Human figures representing the Wise Men, shepherds, etc., move past the crib containing the infant Jesus. Each figure pauses, turns towards the crib, bows, turns back, and then moves away. The pausing action is created by a drive gear with some missing teeth. The turning action is created by two racks which mesh sequentially with a gear on which each figure is mounted. The bowing motion is created by a hinge mounting for each figure, and a push-rod actuation mechanism.

5 Claims, 3 Drawing Figures

ANIMATED CHRISTMAS DISPLAY DEVICE

This invention relates generally to animated display devices, and particularly to display devices depicting the Nativity.

A principal object of the present invention is to provide an animated display device wherein the motion of the figures express reverence in a novel manner and by the use of a novel mechanism.

In particular, it is an object to provide an animated display device depicting the Nativity in a novel and pleasing manner and with a relatively simple mechanism.

In accordance with the present invention, the foregoing objects are met by the provision of an animated display device in which human figures are moved past a reference location in sequence. Each figure bows towards the reference location as it moves by. Also, each figure pauses and turns toward the reference location before it bows.

Preferably, the display device depicts the Nativity, with the crib holding the infant Jesus being at the reference location, and the figures representing Wise Men, shepherds, etc. However, the same motions of the figures can be used to represent the act of paying homage to a monarch, president or other figure of respect. Therefore, the invention is not limited to use in depicting the Nativity.

The drawings and description that follow describe the invention and indicate some of the ways in which it can be used. In addition, some of the advantages provided by the invention will be pointed out.

Figure 1:
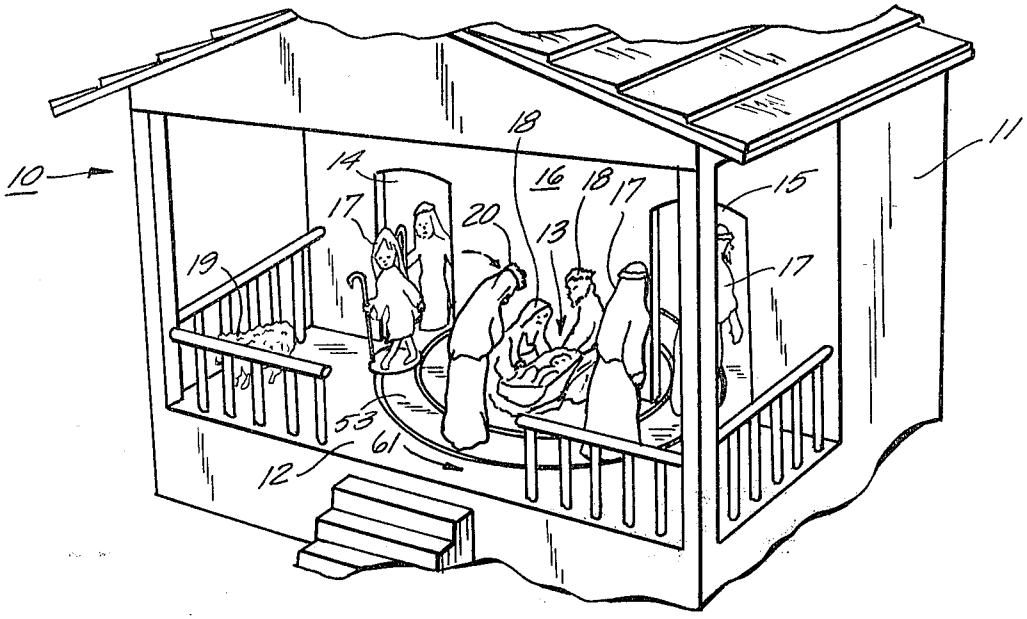
FIG. 1 is a perspective view, partially broken-away, of the display device.

FIG. 1 shows the display device 10 which comprises a stable 11, a stage 12 and a crib 13 with the infant Jesus in it, and movable human figures 17 and 20, and an animal 19, all creating a depiction of the Nativity. Members of the Holy Family are next to the crib 13. The figures 17 represent Wise Men, shepherds, etc. who have come to pay homage to the newborn Baby Jesus.

The human figures 17 and 20 are rotatably mounted on an annular ring 53 which is rotated slowly in the direction indicated by the arrow 61 in FIG. 1. This causes the figures 17 and 20 to move inwardly into the structure of the stable 11 through a hole 15 in the back wall 16 of the structure, and out through another door 14. Thus, the figures continuously move in a circular path past the crib 13.

Figure 3:
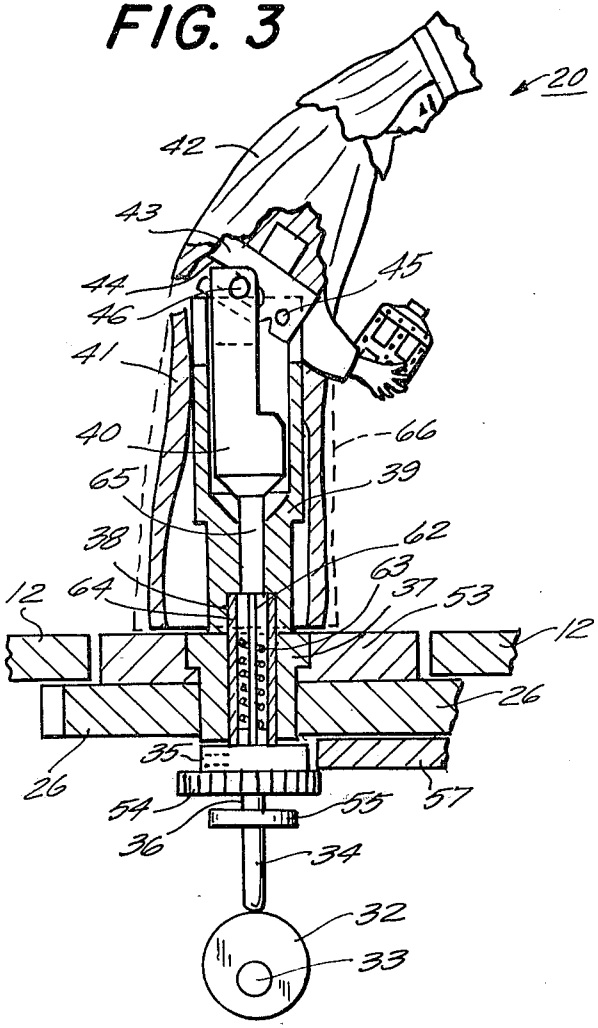
FIG. 3 is a cross-sectional view taken along line 3—3 of FIG. 2.
Figure 2:
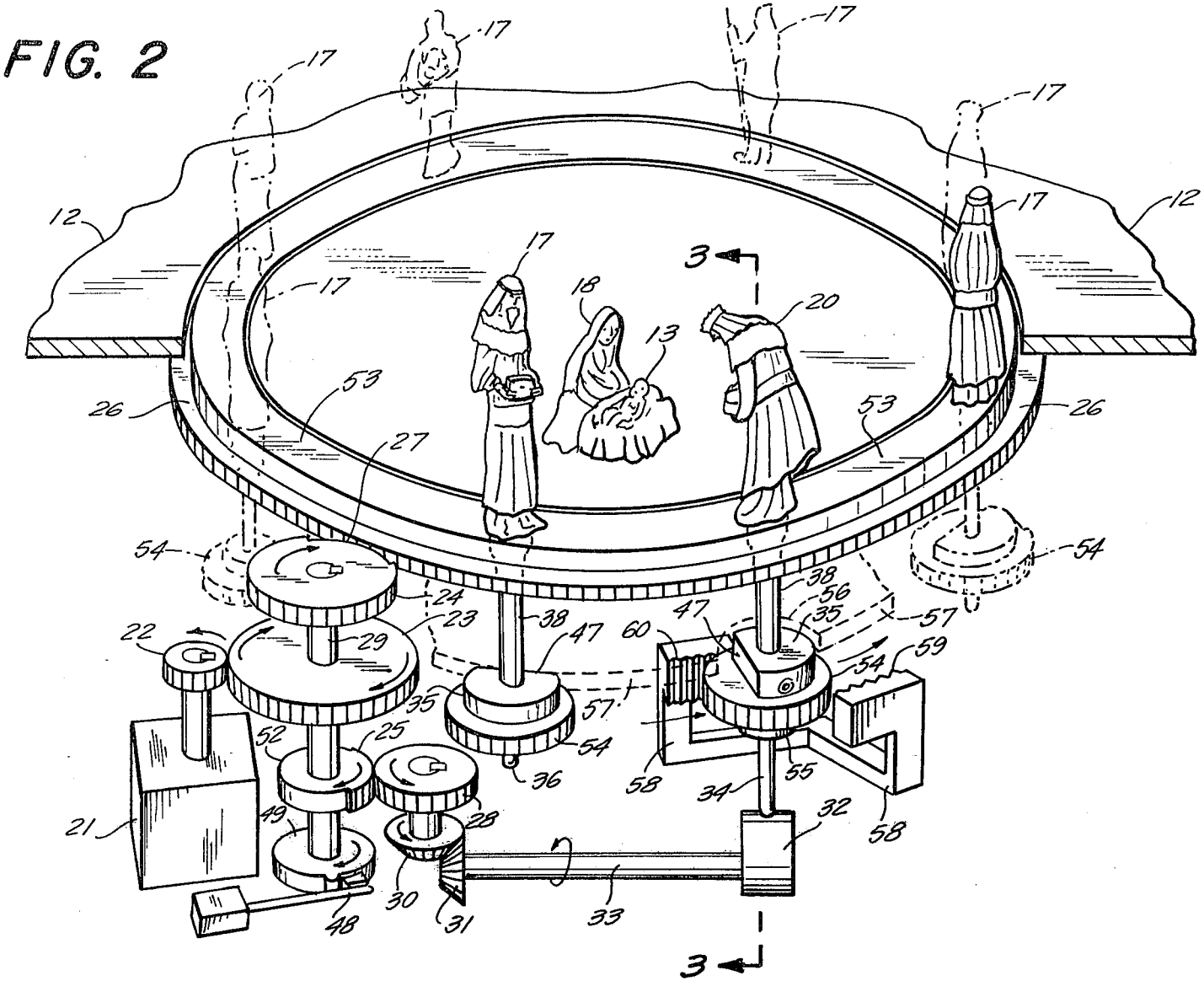
FIG. 2 is a perspective, partially schematic view of the drive mechanism of the display device.

Some or all of the human figures are adapted to make a special motion. For example, the human figure 20 (a King) rotates 90° so that it faces towards the crib 13, and then bows from the waist up. The bowing position of the King 20 is illustrated in FIGS. 1, 2 and 3. Then, the figure turns 90° in the opposite direction to again face forward and resumes its forward motion.

Each figure repeats the above motion when it reaches a position in front of the crib, except that, if desired, some of the figures are not adapted to bow but only to rotate.

FIG. 2 illustrates the manner in which the figures are moved in the fashion described above.

Referring now to FIG. 2, the ring 53 is secured to a relatively large disc 26 with gear teeth in its outer edge. The large disc or gear 26 is rotatably mounted by means which are not shown in the drawings. The mounting means for the disc 26 and the remainder of the mechanism are not shown because they are conventional, and because to show them would unduly complicate the drawings.

The entire mechanism is driven by a single drive motor 21 which rotates a drive gear 22. The drive gear 22 meshes with a gear 23 which is mounted on a shaft 29, upon which also are mounted gears 24 and 25, and a cam 49.

The gear 24 has a "blank" portion 27 from which the gear teeth have been omitted. The teeth of the gear 24 mesh with the teeth of the gear 26 to drive the large gear 26 and thus rotate the ring 53 on which the figures 16 and 20 are mounted. However, when the blank section 27 of the gear 24 is adjacent the gear 26, the gear 26 stops until the blank section has passed and the teeth of the gear 24 again engage the teeth of the gear 26. This causes each figure to stop at a position in front of the crib 13, and gives the figure sufficient time to bow. Therefore, the spacing between adjacent figures such as figures 17 and 20 in FIG. 2, is constant and is calculated, together with the gear ratio of the gears 24 and 26, so that each figure 20 or 17 will consistently arrive at the same location throughout hours of continuous operation.

The gear 25 has teeth over only a small portion of its perimeter; the remainder 52 of the perimeter of the gear 25 is toothless. The toothed potion of gear 25 is dimensioned and mounted relative to gear 24 so that it starts to engage a gear 28 at about the time when the figure 20 has rotated 90° and has stopped. The engagement of gears 25 and 28 then causes the figure to bow and return to an upright position before returning and resuming motion along its circular path.

The gear 28 drives a beveled gear 30 which engages another beveled gear 31 attached to a shaft 33 which rotates a cam 32. The cam 32 drives a cam follower 34 which is secured to a plate 55. The manner in which this mechanism causes the figure to bow now will be described.

Referring to FIG. 3, as well as FIG. 2, each figure 20 comprises an upper half 42 and a lower half 41. The robe of the King 20 shown in FIG. 3 is shown in dashed outline at 66. Within the hollow interior of the lower half 41 (which preferably is made of wood) is a metal housing 39 in which is mounted a piston having an upper enlarged portion 40, and a second portion 65, to which is secured a relatively thin push-rod 62. Attached at the end of the rod 62 is a button 36 which is engaged by the plate 55 which is pushed upwardly by the push-rod 34 under the urging of the cam 32. A spring 63 surrounds the push-rod 62 and abuts against the upper surface of the button 36 and an abutment 34 to provide a downward return force for the button 36, and a force to cause the figure 20 to erect itself again after it has bowed.

A sleeve 38 is rotatably mounted in a bushing 37 and a recessed portion of the housing 39. Secured to the lower end of the sleeve 38 is a gear 54 with a cam portion 35 above it. The bushing 37 is force-fitted into a recess in the ring 53 and the gear 26.

Referring again to FIG. 2, as well as FIG. 3, the cam portion 35 of each gear 54 is circular except for a flat face 47. The face 47 normally moves closely adjacent to the outer edge of a stationary circular plate 57 (also see FIG. 3) which engages the flat face 47 of the cam portion 35 in order to keep the figure 17 or 20 facing in a forward direction until the time when it is desired to rotate it. A semi-circular cutout portion 56 (FIG. 2) is provided in the disc 57 at the stopping point for the figure 20 so that there will be a space in which the cam portion 35 can turn as the figure rotates.

It should be noted that the gears 54 are shown in FIG. 2 at a position considerably lower than they actually are; that is, the sleeves 38 are shown elongated longer than they actually are, for the sake of clarity in showing the operation of the mechanism.

The rotation of each figure is caused when the teeth of each gear 54 meet with the teeth 60 of a stationary rack 58. As the figure moves along, the gear rotates as it moves past the teeth 60. Then, as the figure resumes its motion, when the teeth of gear 24 once again engage the teeth of gear 26, the teeth of gear 54 engage a second set of teeth 59 of the rack 58 which rotates the gear 54 in the opposite direction to return the figure to its forward-facing position.

Now turning again to FIG. 3, the manner in which the figure 20 is caused to bow now will be explained. As the cam 32 rotates, it pushes on the push-rod 34 and the plate 55 to push against the button 36. This pushes the push-rod 62 upwardly and lifts the parts 65 and 40 upwardly also. The cam and pushrod 34 are shown in FIG. 3 in their uppermost positions, in which the figure 20 is at the deepest point in its bowing motion.

Secured to the upper half 42 of the figure 20 is a U-shaped member 43 with a slot 44 through which extends a pin 46 which spans a similar slot in the top portion of the member 40. A pin 45 also extends through the member 43 and the side walls of the housing 39. Thus, as the push-rod 62 and the elements 65 and 40 are pushed upwardly, the member 43 pivots about the pin 45, and the pin 46 pushes upwardly on the member 43 and slides to the left in the slot 44, thus causing the upper half 42 of the figure 20 to pivot forwardly about the point 45 and bow.

As the cam 32 rotates past the position shown in FIG. 3, the spring 63 pushes the button 36 downwardly, urges the push-rod 62, and members 65 and 40 downwardly, sliding the pin 46 to the right in the slot 44, and returning the upper portion 42 of the figure 20 to an upright position, thus ending the bowing motion.

The figure then resumes its forward motion, rotates 90° in the manner described above, and continues on its circular path.

Returning to FIG. 2, the cam 49 has a projection which engages a micro-switch 48 so as to turn on a pair of lamps (not shown) which light the display as each figure approaches the location at which it turns toward the manger 13, thus providing a special lighting effect which enhances the esthetic appeal of the display.

The above description of the invention is intended to be illustrative and not limiting. Various changes or modifications in the embodiments described may occur to those skilled in the art and these can be made without departing from the spirit or scope of the invention.

I claim:

1. An animated display device comprising means for moving a plurality of human figures in sequence past a reference location, bowing means for causing each of said figures to bow towards said reference location when it reaches a predetermined position, rotation means for causing each of said figures to turn towards said reference location before bowing, turn away after bowing, and then to move away from said position, said rotation means including a plurality of gears, each of said figures being secured to one of said gears, and first and second racks positioned in the path of movement of said gears so as to engage them and rotate each gear first in one direction, and then in the other direction.

2. A device as in claim 1 including pause means for causing each of said figures to pause as it bows, and then to move away from said position.

3. A device as in claim 2 in which each of said figures is mounted on a rotatable platform, and including drive means for rotating said platform to move said figures past said reference location, said pause means comprising a gear drivably coupling said drive means to said platform, said gear having a sector without teeth.

4. An animated display device comprising means for moving a plurality of human figures in sequence past a reference location, bowing means for causing each of said figures to bow towards said reference location when it reaches a predetermined position, each of said figures being mounted on a rotatable platform, and including drive means for rotating said platform to move said figures past said reference location, said bowing means including a hinged support for each of figures, pushing means for pushing upwardly on each of said figures to cause it to bend about said hinge, gears means coupled to said drive means, and cam means driven by said gear means, said pushing means including a push-rod driven upwardly and downwardly by said cam means, said gear means including a gear having a sector without teeth, with the teeth on said gear being located so as to actuate said push-rod only when a figure is at said reference location.

5. A device as in claim 1 or claim 4 in which said display device depicts the Nativity, with the infant Jesus Christ at said reference location, said figures depicting visitors coming to pay their respects.

* * * * *